US006905035B2

(12) United States Patent
McKinney, Jr.

(10) Patent No.: US 6,905,035 B2
(45) Date of Patent: Jun. 14, 2005

(54) ACCESSORY ORGANIZER

(75) Inventor: Edward C. McKinney, Jr., San Rafael, CA (US)

(73) Assignee: Sharper Image Corporation, San Francisco, CA (US)

( * ) Notice: Subject to any disclaimer, the term of this patent is extended or adjusted under 35 U.S.C. 154(b) by 269 days.

(21) Appl. No.: 09/862,160

(22) Filed: May 21, 2001

(65) Prior Publication Data

US 2002/0170869 A1 Nov. 21, 2002

(51) Int. Cl.[7] ..... A47F 7/24

(52) U.S. Cl. ..... 211/85.3; 211/94.01; 211/105.3; 211/122

(58) Field of Search ..... 211/122, 1.57, 211/1.3, 85.24, 85.3, 94.01, 113, 46, 123, 1.51, 94, 105.5, 105.6, 124; D6/315; 206/291; 248/316.1, 306; 403/327, 330, 109.3, 109.08

(56) References Cited

U.S. PATENT DOCUMENTS 1,415,316 A * 5/1922 Corbin ..... 211/85.3
2,917,185 A * 12/1959 Kovacs ..... 211/94.01
2,985,311 A * 5/1961 Abel ..... 211/85.3
3,086,657 A * 4/1963 Myers et al. ..... 108/29
3,124,253 A * 3/1964 Petrich ..... 211/94.01
3,160,279 A * 12/1964 Hovey ..... 211/94.01
3,175,697 A * 3/1965 Kelly ..... 211/113
3,331,428 A * 7/1967 Ford ..... 160/331
3,335,872 A * 8/1967 Dodich ..... 211/85.3
3,389,807 A * 6/1968 Manning et al. ..... 211/85.3
3,424,418 A * 1/1969 Freedman et al. ..... 248/304
3,550,184 A * 12/1970 Hachtel ..... 16/87.2
3,592,343 A * 7/1971 Swett et al. ..... 211/113
3,637,084 A * 1/1972 Uitz ..... 16/94 D
3,667,531 A * 6/1972 Wilkins ..... 160/126
3,698,035 A * 10/1972 Salzmann ..... 16/87.6 R
3,722,743 A 3/1973 Atchley ..... 221/77
3,754,664 A * 8/1973 Kotkins ..... 211/94.01
3,789,994 A * 2/1974 Koutnik ..... 211/85.3
3,945,500 A * 3/1976 Meckstroth ..... 211/113
3,954,182 A * 5/1976 McEvers ..... 211/105.3
4,047,440 A * 9/1977 Carriera ..... 74/6
4,219,215 A * 8/1980 Biermann et al. ..... 280/615
4,240,489 A * 12/1980 Madsen ..... 160/126
4,251,124 A * 2/1981 Emanual ..... 312/4
4,340,145 A * 7/1982 Cameron ..... 211/124
4,355,677 A * 10/1982 Madsen ..... 160/126
4,423,904 A * 1/1984 Crawford ..... 297/341
4,437,506 A * 3/1984 Ogita ..... 160/331
D277,436 S * 2/1985 Benedict ..... D6/315
4,585,127 A * 4/1986 Benedict ..... 211/34
D288,035 S * 2/1987 Hollinger et al. ..... D6/324
4,729,148 A * 3/1988 Levy ..... 16/87.2
4,736,854 A * 4/1988 King et al. ..... 206/286
4,742,924 A * 5/1988 Tarlow et al. ..... 211/121
4,757,853 A * 7/1988 Price ..... 160/191
4,771,899 A * 9/1988 Benedict et al. ..... 211/105.3
D298,591 S * 11/1988 Arner et al. ..... D6/315
4,782,947 A * 11/1988 Sheiman ..... 190/13 R
4,801,062 A * 1/1989 Austin ..... 227/128
4,819,708 A * 4/1989 Onosato et al. ..... 160/331

(Continued)

OTHER PUBLICATIONS

Med–Time Benefits: Right Med, Right Dose, Right Time, http://www.eldercarechoice.com/benefits.html, downloaded Mar. 12, 2001, 3 pages.

(Continued)

*Primary Examiner*—Leslie A. Braun
*Assistant Examiner*—Khoa Tran
(74) *Attorney, Agent, or Firm*—Fliesler Meyer LLP

(57) ABSTRACT

An apparatus can be used for organizing clothing accessories such as jewelry, neckties, scarves, and other items. The apparatus can hang from a closet rod and has a slidable track so that the items hanging from hooks attached to the slidable track can be easily accessed.

36 Claims, 4 Drawing Sheets

U.S. PATENT DOCUMENTS 4,846,249 A * 7/1989 Cooper et al. ..... 16/102
4,850,562 A * 7/1989 Mazzanti ..... 206/291
4,872,287 A * 10/1989 Block ..... 16/87 R
4,881,588 A * 11/1989 Madsen ..... 160/126
4,914,862 A * 4/1990 Gregory ..... 49/322
4,984,854 A * 1/1991 DeLavallade ..... 312/330.1
5,018,627 A * 5/1991 Moore ..... 206/291
5,099,989 A * 3/1992 Goodin et al. ..... 206/286
5,123,546 A * 6/1992 Crum ..... 211/59.3
5,139,298 A * 8/1992 Dowell ..... 294/145
5,180,057 A * 1/1993 Franklin ..... 190/103
5,269,402 A * 12/1993 Speckhart et al. ..... 198/416
5,297,713 A * 3/1994 Perra et al. ..... 227/123
D355,770 S 2/1995 Taylor et al. ..... D6/315
5,411,233 A * 5/1995 Grimes et al. ..... 248/305
5,467,808 A * 11/1995 Bell ..... 160/168.1 P
5,474,187 A 12/1995 Taylor et al. ..... 211/1.56
5,507,423 A * 4/1996 Fischer et al. ..... 224/313
5,533,632 A * 7/1996 Patterson et al. ..... 198/678.1
5,645,173 A 7/1997 Taylor et al. ..... 211/1.56
5,647,578 A * 7/1997 Bivens ..... 267/34
D382,717 S * 8/1997 Rolnick et al. ..... D6/315
D394,557 S * 5/1998 Wilcox ..... D6/318
5,782,367 A * 7/1998 Aumasson ..... 206/279
5,806,235 A * 9/1998 Martin ..... 43/57.1
5,813,160 A * 9/1998 Thoelke ..... 135/121
5,826,760 A * 10/1998 Kolton et al. ..... 223/85
5,836,675 A * 11/1998 Woodring ..... 211/1.56
5,897,004 A * 4/1999 Neugebauer et al. ..... 211/113
6,126,302 A * 10/2000 Corn ..... 362/492
6,334,477 B1 * 1/2002 Moir ..... 160/168.1 V
D457,331 S * 5/2002 Pinchuk ..... D6/315
6,517,365 B1 * 2/2003 Bungo et al. ..... 439/162
6,574,902 B1 * 6/2003 Conger ..... 43/2

OTHER PUBLICATIONS

Westclox Operating Instructions for Pill Minder Model 47592, 1 page.
Pillmate PD–503 User Manual, document # 01–PX070–9002, 2 pages.
The Sharper Image, Mar. 2000 Catalog, Item No. S1614, Quiet Power Tie Rack., 2 pages.
The Sharper Image, http://www.sharperimage.com/us/en/catalog/productview.jhtml?sku=SI614, Item No. SI614, downloaded Jul. 3, 2001, 1 page.

* cited by examiner

ACCESSORY ORGANIZER

FIELD OF THE INVENTION

The present invention relates generally to clothing and garment storage systems. More particularly, the present invention relates to an apparatus for organizing clothing accessories such as neckties, scarves, jewelry, and the like.

BACKGROUND

The storage of clothing accessories, such as neckties, scarves, belts, and other similar articles, is difficult because such accessories are typically flexible and have narrow widths and long lengths. Various static devices, such as conventional clothing hangers, hooks, rods, and the like, have been used to store clothing accessories. These static devices suffer from the disadvantage that the accessories are positioned very close together, often overlapping, such that an individual accessory cannot be located and retrieved without disturbing, or even removing, other accessories.

There are several dynamic devices on the market for storing clothing accessories. However, these dynamic devices suffer from a number of disadvantages, a few of which are inadequate controls for easy location and retrieval of accessories, inadequate lighting, difficult installation and inefficient use of space.

Thus, there is a need for an apparatus to store clothing accessories which overcomes the disadvantages of the above mentioned static and dynamic devices.

SUMMARY OF THE INVENTION

The present invention provides an apparatus for organizing clothing accessories. The apparatus includes a housing containing a biasing mechanism to release a slidable track when a release button is depressed. The slidable track has several hooks attached, allowing an individual to hang multiple clothing accessories from each hook.

In another embodiment of the present invention, the apparatus for organizing clothing accessories has an extendable stabilizing rod to limit movement of the apparatus as it is hanging from a closet rod. The stabilizer allows the apparatus to hang from a closet rod and remain substantially horizontal.

In yet another embodiment a hook of the embodiment of the invention is adapted to hang multiple clothing accessories. It is an object of the present invention to store various clothing accessories in a manner so that the clothing accessories can be brought towards an individual without the need for the apparatus requiring batteries.

It is yet another object of the present invention to store clothing accessories in a manner such that the clothing accessories can be easily removed from the apparatus without the need for additional light.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
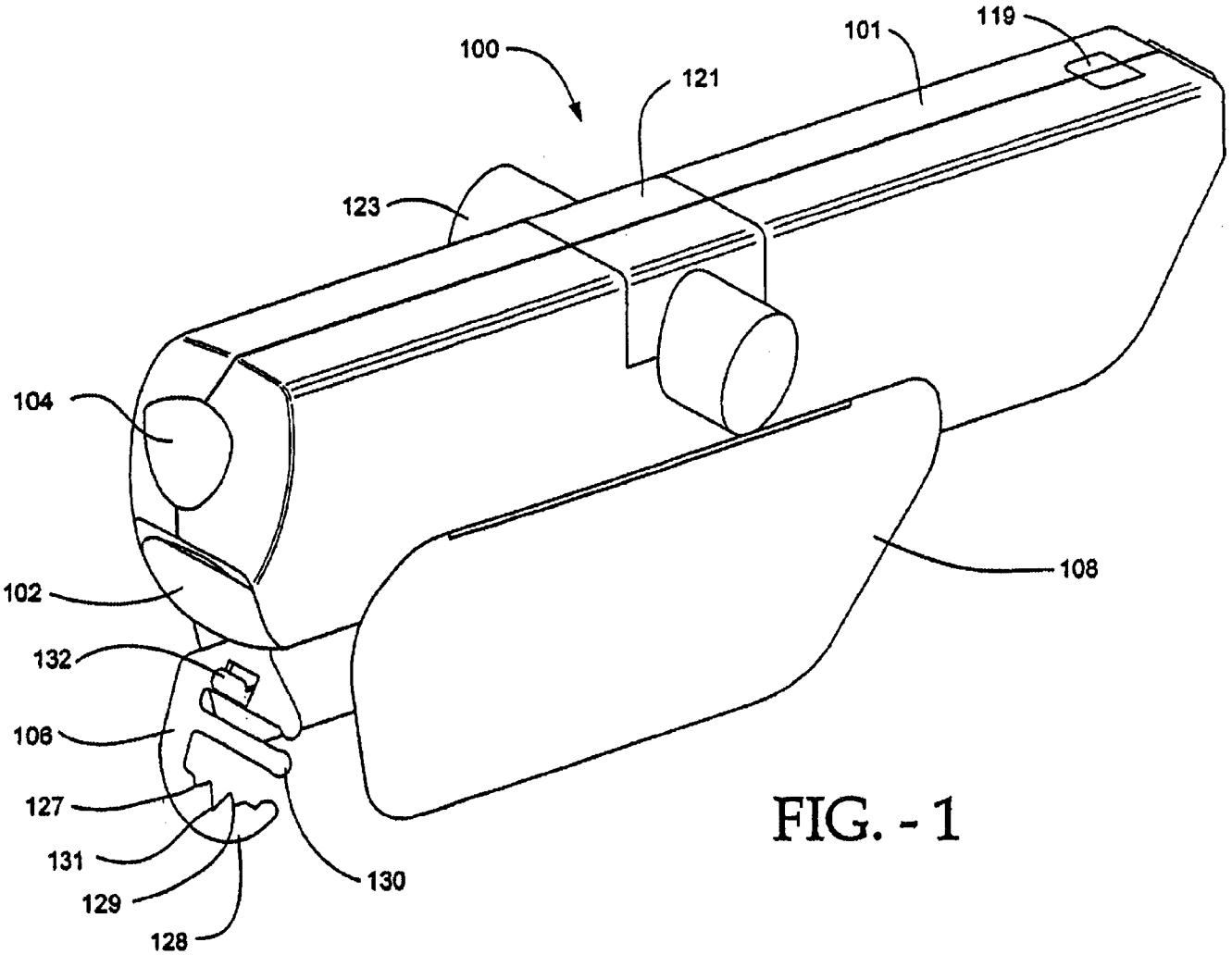
FIG. 1 is a perspective view of an embodiment of the present invention.
Figure 2:
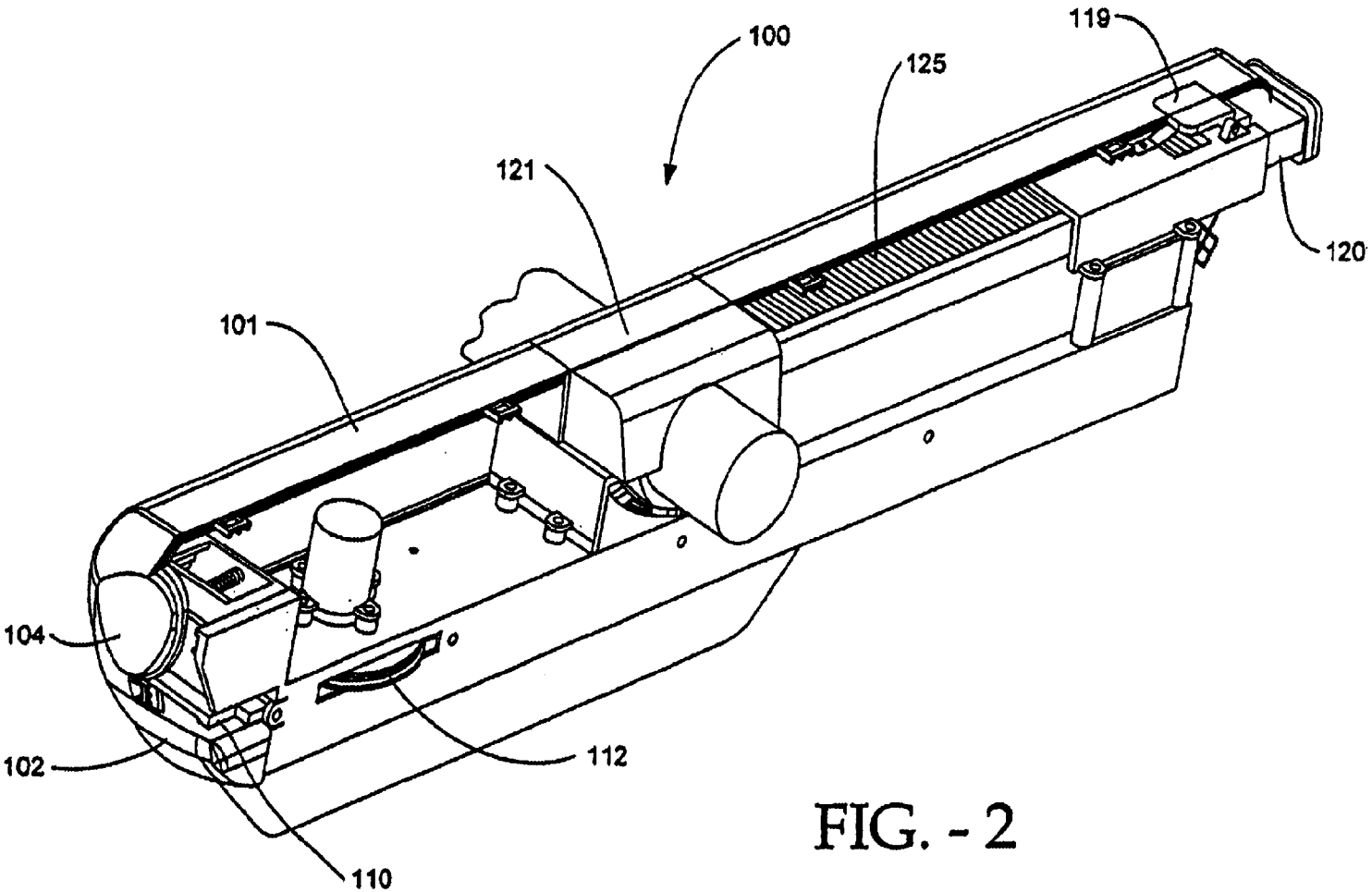
FIG. 2 is a perspective view of an embodiment of the present invention of FIG. 1 with a side cover removed to illustrate several internal features.
Figure 3:
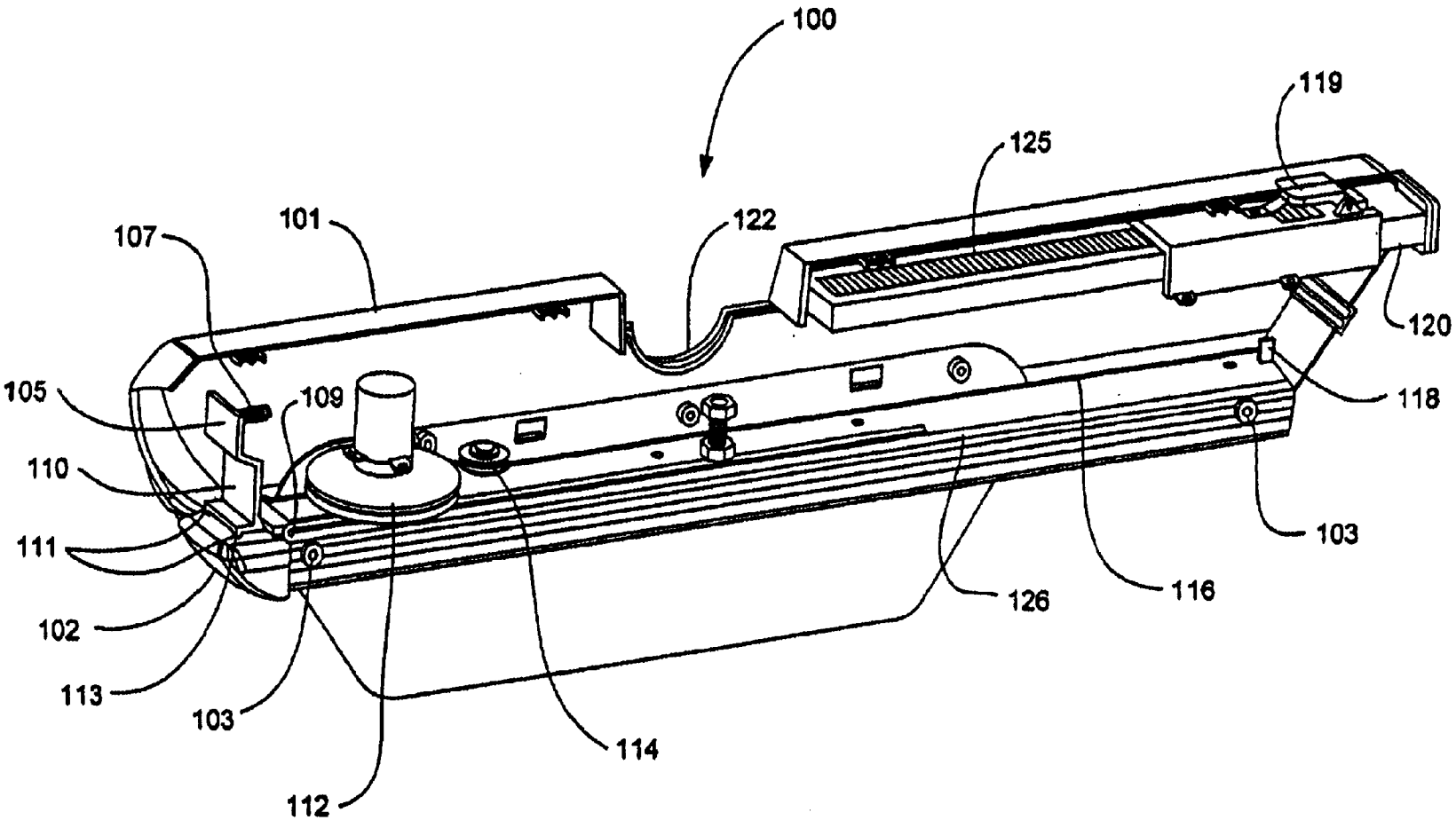
FIG. 3 is a perspective view of an embodiment of the present invention of FIG. 1 with a side cover and several internal components removed to illustrate the biasing mechanism.
Figure 4:
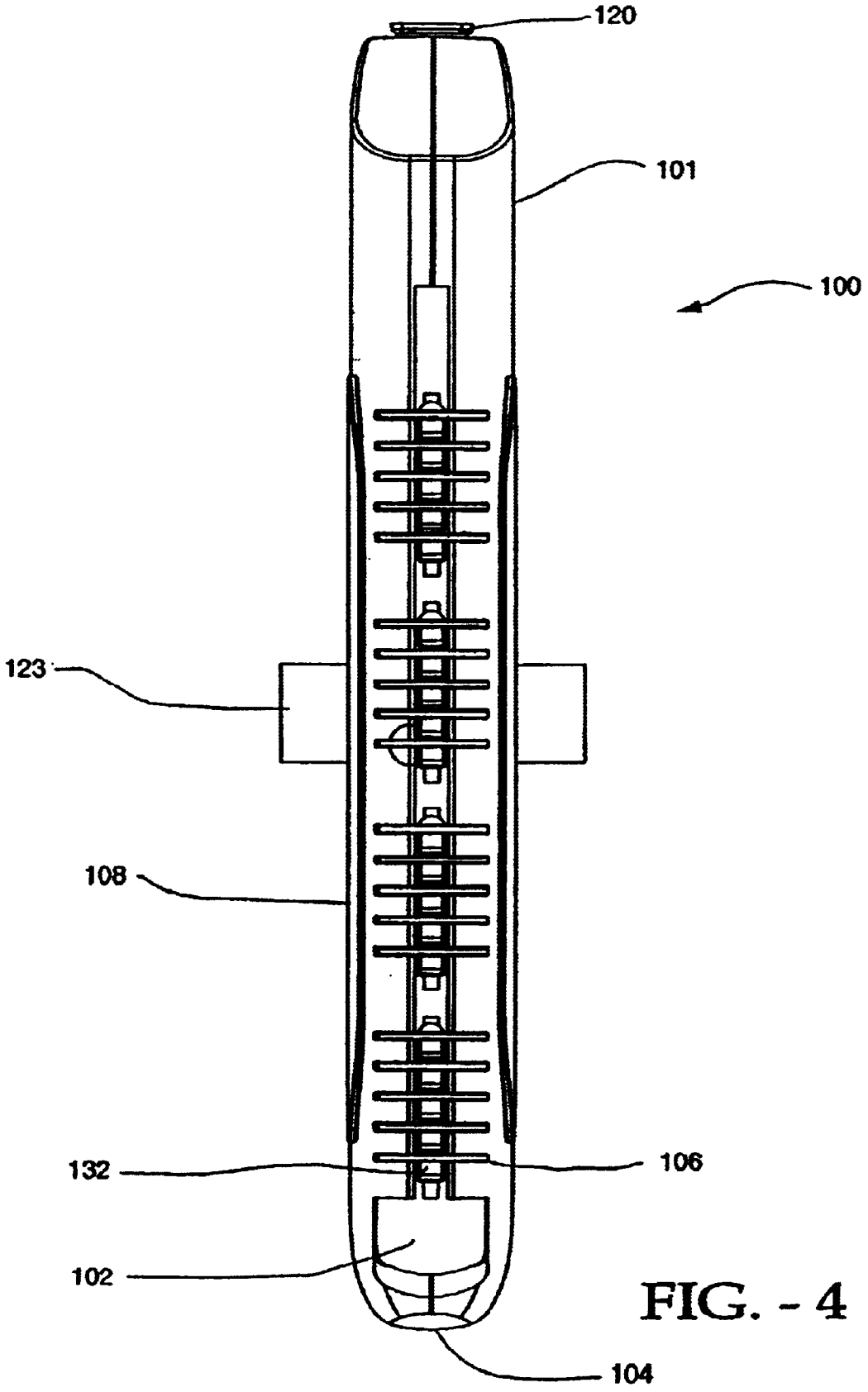
FIG. 4 is a bottom view of an embodiment of the present invention of FIG. 1 illustrating one arrangement of hooks.

Referring to FIGS. 1–3, the accessory organizer 100 has a housing 101, a slidable track 102, hooks 106 and a release button 104.

The slidable track 102 has a groove 126 on each side to limit the length of extension out of the housing 101. The slidable track 102 extends out from the housing 101 up to a length where the track wheels 103 come into contact with the end of the groove 126. Preferably, the grooves 126 extend approximately three quarters of the length of the slidable track 102 so that the slidable track 102 will extend out far enough for an individual to reach any clothing accessories hanging from a hook 106 near the back. In a preferred embodiment, the slidable track 102 will extend approximately nine inches out from the housing which is about twelve to twenty inches long. The slidable track 102 also has two track retaining holes 113 located near the front end of the slidable track 102.

The latch mechanism 110 holds the slidable track 102 within the housing 101 until an individual depresses the release button 104. The latch mechanism 110 includes two prongs 111, a pivot pin 109 and a spring 107. The prongs 111 insert into the retaining holes 113 located near the front end of the slidable track 102. The pivot pin 109 connects the latch mechanism 110 with the housing 101. The pin 109 pass through one edge of the latch mechanism 110 and engages pin holes located in the housing 101 (see FIG. 3). When the release button 104 is depressed, the button 104 presses against the face 105 of the latch mechanism 110 and the latch mechanism 110 rotates about the pin 109.

The slidable track 102 will then extend out of the housing 101 as described below. There is a spring 107 attached with the latch mechanism 110 to bias the latch mechanism 110 forward. Thus, the spring 107 keeps the prongs 111 inserted into the holes 113 until the release button 104 is depressed.

Each hook 106 has a lower finger 128, a middle finger 130 and a tab 132. The multiple fingers allow several objects to be retained simultaneously from a single hook 106. The lower finger 128 has multiple ridges along the length of the finger. The multiple ridges allow clothing accessories, such as a bracelet or a chain or belts, to be hung from the lower finger 128 without sliding across the surface of the lower finger 128. Essentially, each ridge functions as a slot by which a piece of jewelry may hang from. Additionally, the ridges do not allow the jewelry to slide into another piece of jewelry hanging from the same lower finger 128. In a preferred embodiment the ridges have located there between grooves. In this preferred embodiment there is a central deep groove 131 with shallower grooves 127 and 129 located on either side of the deeper groove 131. Thus finger 128 has an uneven surface. The middle finger 130 has a smooth horizontal surface. Preferably, the smooth surface is used to hang clothing accessories such as neckties, scarfs and other like items. Jewelry, such as the previously mentioned bracelet or chain may also be hung from the middle finger 130. However, jewelry and other similar clothing accessories with a smooth surface will tend to slide around and become tangled on the middle finger 130. Thus, the lower finger 128 is preferred to hang such items. The hook 106 also contains a tab 132. The tab 132 is preferably used to hang clothing accessories such as a belt. The three fingers allow an individual to hang several clothing accessories from a single hook 106. By way of example only, a single hook 106 can carry several pieces of jewelry, a necktie and a belt.

In the preferred embodiment of the present invention, the accessory organizer 100 has twenty hooks 106. One can appreciate that the accessory organizer 100 can have fewer than twenty hooks 106 or more than twenty hooks 106. When the accessory organizer has twenty hooks 106, the hooks 106 are connected with the slidable track 102 in four groups. Each group contains five hooks 106. Within each group, each hook 106 has a limited range of horizontal motion so that an individual may separate the hooks 106. It becomes easier to access the clothing accessories hanging from each hook 106 when some space is made between each hook 106. Additionally, each hook 106 can pivot at the point that the hook 106 is connected with the slidable track 102. Allowing each hook 106 to pivot slightly also makes it easier to access the clothing accessories hanging from the several hooks 106.

The accessory organizer 100 is preferably hung from a closet rod 123 or metal closet system, helping an individual to better organize their clothing accessories. The accessory organizer 100 has a rod engaging device 122 and a stabilizing rod 120 to allow the accessory organizer to hang from a closet rod or metal closet system. To hang the accessory organizer 100 from a closet rod, the rod cover 121 must first be removed. An individual can then lift the accessory organizer 100 up towards the closet rod until the closet rod engages the rod engaging device 122. The rod engaging device 122 is a semicircular shaped cavity in the housing 101. With the closet rod within the rod engaging device 122, the individual can then replace the cover 121 back onto the housing 101. The cover also has a semicircular cavity to accommodate the closet bar. With the cover 121 replaced and screwed into place, the accessory organizer 100 can now hang from the closet rod. However, since the length of the accessory organizer 100 is not typically equal to the depth of the closet, the accessory organizer 100 will tend to swing from the closet rod.

To limit the movement of the accessory organizer 100, the housing 101 includes a stabilizing rod 120. Rod 120 is pulled out of the housing 101 to release the stabilizing rod 120 from the located position, an individual depresses the release button 119. While the release button 119 is depressed, the stabilizing rod 120 maybe pushed back into the housing 101. The stabilizing rod 120 extends from the back of the housing 101 towards the back wall of the closet. When the stabilizing rod 120 contacts the closet back wall, the accessory organizer 100 will not be free to swing from the closet rod.

While the accessory organizer 100 sits in a closet, the slidable track 102 generally remain within the housing 101 to minimize the space that each accessory organizer 100 takes up in the closet. When an individual needs to retrieve a clothing accessory hanging from a hook 106, the slidable track 102 is released from the housing 101. To release the slidable track 104 from the housing 101 the individual depresses the release button 104. By pressing the release button 104, the face 105 of the latch mechanism 110 compresses the spring 107 and the latch mechanism pivots about the pin 109. When pivoting about the pin 109, the two engagement elements 111 are vertically raised out of the retaining holes 113. Thus, the slidable track 102 will extend out of the housing 101, towards the individual.

A biasing mechanism urges the slidable track 102 out of the housing 101 when the release button 104 is depressed. The biasing mechanism includes a cord 116, a stationary tab 118, a gear 112 and an axis wheel 114. The stationary tab 118 is connected with the top surface of the slidable track 102, near the back. One end of the cord 116 is tied to the stationary tab 118. The other end of the cord 116 is attached to the gear 112. The gear 112 is connected with the housing 101 near the front end of the slidable track 102. When the slidable track 102 is retained within the housing 101, there is tension within the cord 116. The tension within the cord 116 results because the spring (not shown) in the gear 112 is at its maximum stored potential energy state when the stationary tab 118 is at the farthest position from the gear 112 (see FIG. 3).

The slidable track 102 extends linearly from the housing 101. The positioning of the gear 112 is such that the cord 116 contacts the gear 112 not substantially along the centerline of the slidable track 102. Accordingly, the cord 116 between the gear 112 and the stationary tab 118 would normally be at an angle relative to the centerline of the slidable track 102. If the cord 116 was allowed to remain at an angle to the centerline of the slidable track 102, the slidable track 102 would have to overcome stronger resistance forces to extend from the housing 101. So that the slidable track 102 encounters minimum resistance while extending linearly from the housing 101, the biasing mechanism includes the axis wheel 114. The axis wheel 114 places the cord 116 that is between the axis wheel 114 and the stationary tab 118 in a straight line. The straight line is preferably directly over the centerline of the slidable track 102.

When the release button 104 is depressed, the gear 112 will retract the cord 116 and draw the stationary tab 118 closer. With the aid of the axis wheel 114, the stationary tab 118 is brought towards the gear 112 is a substantially straight line. As mentioned previously, the stationary tab 118 is connected to the slidable track 102. Therefore, when the stationary tab 118 is pulled towards the gear 112, the slidable track 102 extends from the housing 101.

The slidable track 102 extends linearly from the housing 101, remaining substantially horizontal throughout the entire range of motion. The slidable track 102 moves along track wheels 103 that engage the grooves 126 in the slidable track 102. Thus, the slidable track 102 hangs from the track wheels 103. The housing 101 preferably contains four track wheels 103 to provide support for the slidable track 102. The speed at which the slidable track 102 extends from the housing 101 is governed by the rate at which the gear 112 pulls the stationary tab 118 towards it. To help govern this speed, the track wheels 103 further limit the speed at which the slidable track 102 may extend from the housing 101. The track wheels 103 are manufactured from preferably an engineering plastic, with a graphite bearing so that the materials provides resistance simply by the track wheels 103 rotating. The track wheels 103 and bearings may be manufactured from other material.

When a clothing accessory has been removed from a hook 106, the slidable track 102 should be returned back into the housing 101. By applying pressure to the forward edge of the sliding track 102, the spring in the gear 112 will be compressed and the slidable track 107 can be eased back into the housing 101. The engaging elements 111 of the latch mechanism 110 will insert back into the holes 113 holding the slidable track 102 within the housing 101 for the next use.

The foregoing description of preferred embodiments of the present invention has been provided for the purposes of illustration and description. It is not intended to be exhaustive or to limit the invention to the precise forms disclosed. Many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. An apparatus for organizing accessories, comprising:

a housing;

a slidable track wherein the slidable track has a groove;

a plurality of wheels connected with the housing such that the wheels engage the groove of the slidable track so that the slidable track remains substantially horizontal when fully extended out of the housing;

a latch mechanism that can selectively retain the slidable track within the housing;

a plurality of hooks connected with the slidable track; and a release button, when depressed releases the slidable track from the latch mechanism so that the slidable track extends linearly out of the housing.

2. An apparatus for organizing accessories, comprising:

a housing;

a slidable track;

a biasing mechanism that can urge the track out of the housing, wherein the biasing mechanism includes a retractable line which is attached to the slidable track and a guide that causes the line to be positioned along a center line of the track;

a latch mechanism that can selectively retain the slidable track within the housing;

a plurality of hooks connected with the slidable track; and a release button, when depressed releases the slidable track from the latch mechanism so that the slidable track extends linearly out of the housing.

3. An apparatus for organizing accessories, comprising:

a housing;

a slidable track;

a biasing mechanism that can extend the slidable track out of the housing, wherein the biasing mechanism includes a retractable cord connected with the slidable track;

a latch mechanism that can selectively retain the slidable track within the housing; and a plurality of hooks connected with the slidable track.

4. An apparatus according to claim 3, wherein each hook has multiple fingers and a tab so that several objects can be retained simultaneously from a single hook.

5. An apparatus according to claim 3, wherein each hook has a first finger and a second finger, where the first finger has a smooth surface, and further where the second finger has an uneven surface.

6. An apparatus according to claim 3, wherein there are twenty books connected with the slidable track.

7. An apparatus according to claim 6, wherein the twenty hooks are arranged in four groups of five along the slidable track for easy sorting.

8. The apparatus according to claim 3 wherein at least some of the hooks have multiple levels adapted to retain more than one item on each hook.

9. The apparatus of claim 3 wherein at least one of said hooks includes a tab, a first finger and a second finger, with the second finger having a plurality of grooves.

10. The apparatus of claim 3 wherein at least one of said hooks includes an upper tab, below which is positioned a middle finger, and below which middle finger is positioned a lower finger, with the lower finger including a plurality of grooves.

11. An apparatus for organizing accessories, comprising:

a housing;

a slidable track;

a latch mechanism that can selectively retain the slidable track within the housing;

a plurality of hooks connected with the slidable track; and means for automatically extending the slidable track linearly out of the housing;

wherein the slidable track has a groove, and the housing further has track wheels to engage the groove of the slidable track so that the slidable track remains substantially horizontal when fully extended out of the housing.

12. An apparatus for organizing accessories, comprising:

a housing;

a slidable track a latch mechanism that can selectively retain the slidable track within the housing;

a plurality of hooks connected with the slidable track; and means for automatically extending the slidable track linearly out of the housing;

wherein said extending means includes a biasing means for urging said track out of said body when said latch mechanism is released;

wherein said biasing means includes a spring biased pulley connected to a line with the line connected to the track and the pulley connected to the housing.

13. An apparatus for organizing accessories, comprising:

a housing;

a slidable track;

a latch mechanism that can selectively retain the slidable track within the housing;

a plurality of hooks connected with the slidable track;

a mechanism for extending the slidable track linearly out of the housing wherein the mechanism includes a retractable line which is attached to the slidable track; and a guide connected with the housing that causes the retractable line to be positioned along a center line of the track.

14. An apparatus for organizing accessories, comprising:

a slidable track;

a housing;

one of said slidable track and said housing having a groove;

the other of said track and said housing having track wheels to engage the groove;

a plurality of hooks connected with the track;

means for retaining the slidable track within the housing; and means for releasing the slidable track from the housing, so that the slidable track automatically extends linearly away from the housing.

15. An apparatus according to claim 14, wherein each hook has multiple fingers and a tab so that several objects can be retained simultaneously from a single hook.

16. An apparatus according to claim 14, wherein each hook has a first finger and a second finger, where the first finger has a smooth surface, and further where the second finger has an uneven surface.

17. An apparatus according to claim 14, wherein there are twenty hooks connected with the slidable track.

18. An apparatus according to claim 17, wherein the twenty hooks are arranged in four groups of five along the slidable track for easy sorting.

19. The apparatus according to claim 14 wherein at least some of the hooks have multiple levels adapted to retain more than one item on each hook.

20. The apparatus of claim 14 wherein at least one of said hooks includes a tab, a first finger and a second finger, with the second finger having a plurality of grooves.

21. The apparatus of claim 14 wherein at least one of said hooks includes an upper tab, below which is positioned a middle finger, and below which middle finger is positioned a lower finger, with the lower finger including a plurality of grooves.

22. An apparatus for organizing accessories, comprising:

a slidable track;

a housing;

one of said slidable track and said housing having a groove;

the other of said track and said housing having track wheels to engage the groove;

a plurality of hooks connected with the track;

means for retaining the slidable track within the housing; and means for releasing the slidable track from the housing, so that the slidable track extends linearly away from the housing, wherein the releasing means includes a biasing means for urging the slidable track out of the body when the releasing means is actuated wherein said biasing means includes a spring biased pulley connected to a line with the line connected to the track and the pulley connected to the housing.

23. An apparatus for organizing accessories, comprising:

a slidable track;

a housing;

one of said slidable track and said housing having a groove;

the other of said track and said housing having track wheels to engage the groove;

a plurality of hooks connected with the track;

means for retaining the slidable track within the housing; and means for releasing the slidable track from the housing, so that the slidable track extends linearly away from the housing, wherein the releasing means includes a biasing means for urging the slidable track out of the body when the releasing means is actuated;

wherein said biasing means includes a spring biased pulley connected to a line with the line connected to the track and the pulley connected to the housing.

24. An apparatus for organizing accessories, comprising:

a slidable track;

a housing;

one of said slidable track and said housing having a groove;

the other of said track and said housing having track wheels to engage the groove;

a plurality of hooks connected with the track;

means for retaining the slidable track within the housing;

means for releasing the slidable track from the housing, so that the slidable track extends linearly away from the housing; and a biasing mechanism connected with the housing that can urge the track out of the housing, wherein the bias mechanism includes a retractable line which is attached to the slidable track and a guide that causes the retractable line to be positioned along a center line of the track.

25. An apparatus for organizing objects, comprising:

a housing;

a slidable track;

a plurality of hooks connected with the slidable track, wherein at least some of the hooks have multiple levels adapted to retain more than one item at a time from a single hook;

a biasing mechanism adapted to urge the slidable track out of the housing, wherein the biasing mechanism includes a retractable cord connected with the slidable track;

a latch mechanism for retaining the slidable track within the housing; and a release button for releasing the slidable track, so that the slidable track can be urged out of the housing.

26. The apparatus of claim 25 wherein at least one of said hooks includes a tab, a first finger and a second finger, with the second finger having a plurality of grooves.

27. The apparatus of claim 25 wherein at least one of said hooks includes an upper tab, below which is positioned a middle finger, and below which middle finger is positioned a lower finger, with the lower finger including a plurality of grooves.

28. An apparatus for organizing objects, comprising:

a housing;

a slidable track;

a plurality of hooks connected with the slidable track, wherein at least some of the hooks have multiple levels adapted to retain more than one item at a time from a single hook;

a latch mechanism for retaining the slidable track within the housing;

a release button for releasing the slidable track, so that the slidable track will automatically extend linearly out of the housing; and a biasing mechanism that can urge the track out of the housing, which biasing mechanism includes a retractable line which is attached to the slidable track and a guide that causes the line to be positioned along a center line of the slidable track.

29. An apparatus for organizing accessories comprising:

an extendable support;

a biasing means for extending said extendable support;

a plurality of hook mechanisms coupled to said support;

each hook mechanism including at least first and second fingers and a tab; and wherein said first finger has a smooth surface and said second finger has an uneven surface;

wherein said biasing means includes a retractable cord.

30. The apparatus of claim 29 wherein said automatically extendable support is a track.

31. The apparatus of claim 30 including a mounting means for mounting the apparatus in a closet with said track in an extended position projecting out of the closet.

32. The apparatus of claim 29 including a mounting means for mounting the apparatus in a closet.

33. An apparatus for organizing accessories comprising:

a housing;

a slidable track;

a plurality of hook mechanisms coupled to said track;

each hook mechanism including at least first and second fingers and a tab, wherein said first finger has a smooth surface and said second finger has an uneven surface; and a biasing mechanism that can urge the track out of the housing, wherein the biasing mechanism includes a retractable line which is attached to the track and a guide that causes the line to be positioned along a center line of the track.

34. An apparatus for organizing accessories, comprising:

a housing;

a slidable track;

a biasing mechanism that can urge the track out of the housing, wherein the biasing mechanism includes a retractable line which is attached to the slidable track;

a latch mechanism that can selectively retain the slidable track within the housing;

a plurality of hooks connected with the slidable track; and a release button, when depressed releases the slidable track from the latch mechanism so that the slidable track can be urged out of the housing.

35. An apparatus for organizing accessories, comprising:

a housing;

a slidable track movably mounted in said housing;

a plurality of hooks connected with the track;

means for retaining the slidable track within the housing;

means for releasing the slidable track from the housing, so that the slidable track extends linearly away from the housing; and a biasing mechanism connected with the housing that can urge the track out of the housing, wherein the biasing mechanism includes a retractable line which is attached to the slidable track.

36. An apparatus for organizing accessories comprising:

a housing;

a slidable track;

a plurality of hook mechanisms coupled to said track;

each hook mechanism including at least first and second fingers and a tab, wherein said first finger has a smooth surface and said second finger has an uneven surface; and a biasing mechanism that can urge the track out of the housing, wherein the biasing mechanism includes a retractable line which is attached to the track.

* * * * *